United States Patent [19]

Skolnick et al.

[11] Patent Number: 4,498,367

[45] Date of Patent: Feb. 12, 1985

[54] ENERGY TRANSFER THROUGH A MULTI-LAYER LINER FOR SHAPED CHARGES

[75] Inventors: Saul Skolnick; Albert Goodman, both of Albuquerque, N. Mex.

[73] Assignee: Southwest Energy Group, Ltd., Albuquerque, N. Mex.

[21] Appl. No.: 429,247

[22] Filed: Sep. 30, 1982

[51] Int. Cl.[3] ..... C06B 21/00; F42B 33/10

[52] U.S. Cl. ..... 86/1 R; 29/1.21; 102/306; 102/307; 102/309

[58] Field of Search ..... 29/1.21; 86/1 R, 17; 102/306, 307, 309

[56] References Cited

U.S. PATENT DOCUMENTS

| | | | |
|---|---|---|---|
| 3,077,834 | 2/1963 | Caldwell | 86/1 R X |
| 3,147,707 | 9/1964 | Caldwell | 102/309 |
| 3,893,814 | 7/1975 | McGhee | 86/17 X |
| 3,948,184 | 4/1976 | Pierre et al. | 102/522 |
| 4,106,411 | 8/1978 | Borcher et al. | 102/495 |

*Primary Examiner*—Leland A. Sebastian

*Attorney, Agent, or Firm*—K. S. Cornaby

[57] ABSTRACT

This invention relates to the determination of parameters for selecting materials for use as liners in shaped charges to transfer the greatest amount of energy to the explosive jet. Multi-layer liners constructed of metal in shaped charges for oil well perforators or other applications are selected in accordance with the invention to maximize the penetrating effect of the explosive jet by reference to four parameters: (1) Adjusting the explosive charge to liner mass ratio to achieve a balance between the amount of explosive used in a shaped charge and the areal density of the liner material; (2) Adjusting the ductility of each layer of a multi-layer liner to enhance the formation of a longer energy jet; (3) Buffering the intermediate layers of a multi-layer liner by varying the properties of each layer, e.g., composition, thickness, ductility, acoustic impedance and areal density, to protect the final inside layer of high density material from shattering upon impact of the explosive force and, instead, flow smoothly into a jet; and (4) Adjusting the impedance of the layers in a liner to enhance the transmission and reduce the reflection of explosive energy across the interface between layers.

6 Claims, 3 Drawing Figures

ENERGY TRANSFER THROUGH A MULTI-LAYER LINER FOR SHAPED CHARGES

The invention described herein was made partially in the course of, or under contract with the U.S. Atomic Energy Commission.

BACKGROUND OF THE INVENTION

This invention relates to improvements in the selection of materials for multilayered liners in shaped charges to enhance the formation of high energy impact for oil well perforators and other shaped charge applications, such as military applications.

Following the experience of World War II in which portable anti-tank weapons were developed using explosive charges in various shapes to enhance the armor penetration capacity of such projectiles, it became apparent that such shaped projectiles could be employed in other areas. Specifically, in the field of oil well perforating devices, the so-called shaped charge quickly came into use for the purpose of enhancing rate of flow in an oil well. The charge had a cavity or recess in the forward end of an explosive projectile, and the cavity was lined typically with a dense material such as copper. In use, when the explosive charge was ignited, the detonation wave engaged the metal liner, causing the liner to collapse inwardly upon itself into the cavity. As the collapsing liner reached the center of the cavity, a small forward portion of the liner formed an extremely high-velocity jet of energy which was then responsible for the relatively deep penetration achieved in early oil well perforating devices.

The remainder of the collapsed liner formed a large slug of material which followed the advancing energy jet at a much lower velocity and contributed little or nothing to penetration. The depth of penetration into the target by the jet depended then as it does today on the characteristics of the material of which the liner is made. In general, it is agreed that the liner material for a shaped charge should have a high density and be capable of flowing smoothly into a long jet. Subsequent years of experimentation in this field have brought several developments in an attempt to provide deeper penetration with greater efficiency. Nevertheless, the full potential of the shaped charge device was not achieved.

One of the problems perceived by experimenters in the field was that of the presence of the relatively massive slug which formed following the high velocity jet. In many instances, the slug tended to plug the hole formed by the jet thus inhibiting or preventing the flow of oil. Attempts were undertaken to provide for the inclusion in shaped charge liners of materials which would cause the slug to vaporize or liquify. Other attempts were made to remove the presence of the plug by using liners made of two different materials, i.e., an outer easily vaporizable metal liner next to the explosive charge, and an inner higher density metal liner surrounding the cavity. Changes were proposed in the shapes of the cavity, including conical, hemispherical and others. These efforts were mostly directed toward minimizing the establishment or the effect of the slug. Many other efforts concentrated in the area of altering the physical state of the liner material, such as granularizing or sintering the liner material also to minimize the effect of the slug.

While some of these developments have provided small or moderate increases in the momentum of the jet, there has been no recognition of the fundamental scientific principles and the necessary qualities in liner materials which should be considered in combining the amounts of explosive charge with the optimum liner materials and designs to transfer the greatest amount of energy from the explosive detonation to the high-velocity jet.

It is therefore an objective of this invention to provide criteria for the selection of materials used in multi-layered liners in combination with explosive materials in shaped charges.

It is also an objective of this invention to provide means for increasing the transmission of explosive energy from the detonating explosive to the high velocity jet of a shaped charge.

It is a further objective to provide for two or more layers of material in shaped charges to minimize shattering of the inner layer next to the cavity.

It is still a further objective to provide for reduced reflection of explosive energy from the interface within multi-layered liners and from the interface between the liner and the explosive.

These and further objectives will become obvious in view of the following explanation of the invention.

SUMMARY OF THE INVENTION

According to the invention, the materials selected for use in forming the liners in shaped charge oil well perforators should conform to one or more of the following four control parameters: (1) Adjust the explosive charge to liner mass ratio by maximizing the amount of explosive used and minimizing the mass of the areal density or liner material per unit consistent with other device design constraints. The purpose of this is to optimize the transfer of energy from the detonation through the liner to the high velocity jet. (2) Adjusting the ductility of the materials used in each layer by choice of material or by processing the material for example by alloying, sintering or powdered metal pressing to increase the ductility to the maximum permitted by other material property considerations, e.g., density, thickness, and the like to form a longer high velocity jet. (3) Adjusting the thickness, ductility, acoustical impedance, areal density, and other properties of the liner material to buffer the high density inner layer next to the cavity to prevent shattering of the layer by the explosive force and to promote the smooth flow of the liner material into the creation of the high velocity jet. (4) Matching the acoustical or shock impedance of the different layers of materials in a liner to reduce or eliminate the reflection of energy or shock bounce from the detonation force at the interface of the layers of materials, and to promote the maximum transmission of explosive energy across such material interfaces to form the maximum momentum in the high velocity jet.

BRIEF DESCRIPTION OF THE DRAWINGS

Preferred embodiments of the invention are illustrated in the accompanying drawing, in which.

DETAILED DESCRIPTION OF THE PREFERRED EMBODIMENTS

Figure 1:
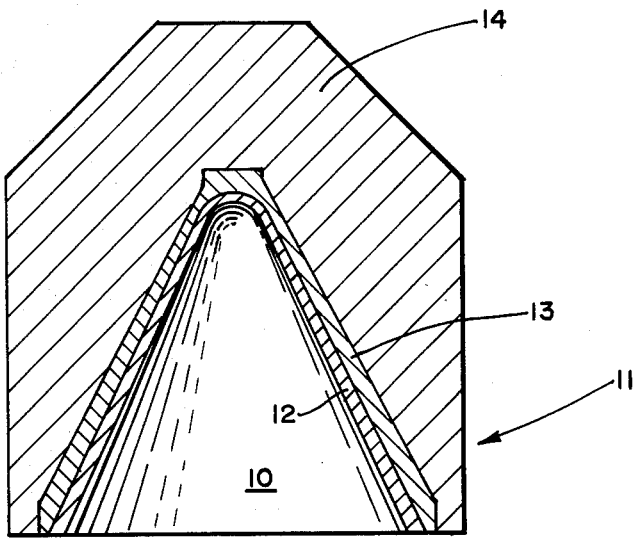
FIG. 1 is an elevational cross-section of a shaped charge showing a conical cavity and two layers in the liner.
Figure 2:
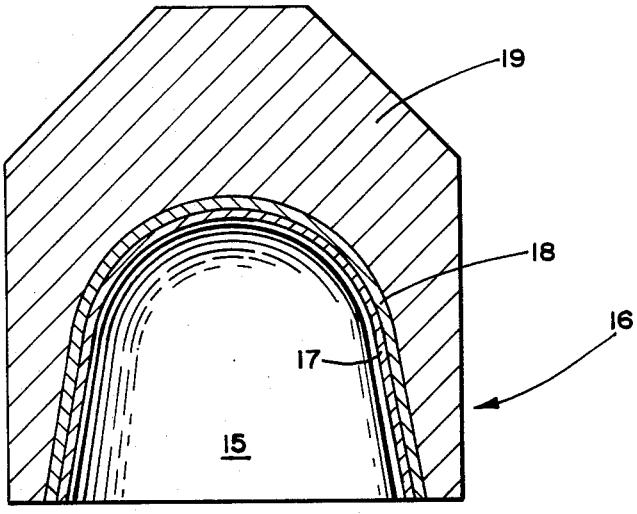
FIG. 2, an elevational section of a shaped charge showing a hemispherical cavity and a two layered liner.
Figure 3:
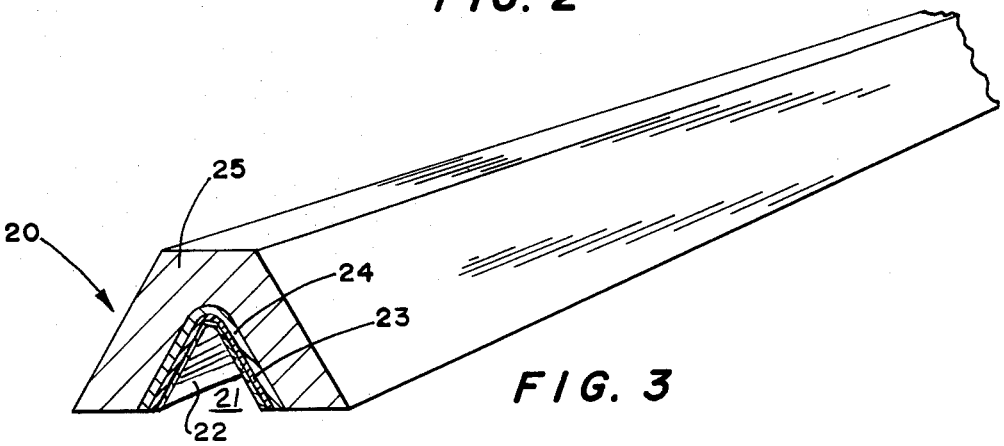
FIG. 3, a perspective view of a linear shaped charge showing a linear cavity with three layers in the liner.

As shown in FIGS. 1, 2 and 3, the invention contemplates a shaped charge using a variety of cavity and shape configurations, including, but not limited to, conical, hemispherical and linear.

The conically shaped cavity 10 in a standard shaped charge configuration 11 as shown in FIG. 1, has a bimetallic liner comprising an inner layer 12 next to cavity 10 and an outer layer 13 next to the explosive charge 14.

FIG. 2 illustrates the hemispherically shaped cavity 15 of a shaped charge 16 surrounded by an inner layer 17 and an outer layer 18 next to an explosive charge 19.

The linear shaped charge 20 is shown in FIG. 3, and has a linear inverted trough-shaped cavity 21. This embodiment shows an example of the use of three layers of material comprising the liner. An inner layer 22 next to the cavity 21 is enclosed by an intermediate layer 23 which is in turn surrounded by an outer layer 24 next to the explosive charge 25.

In applying the parameters of the invention to the selection of materials to be used in the shaped charge liner layers, it is important to note that the objective in practicing the invention is to produce as long and as dense a jet as possible and having the highest possible velocity. Experimentation has shown that the longer a high velocity jet, the greater the penetration. Previous studies have shown, of course, that the higher the velocity of the resulting jet, the greater the penetration into an oil well wall and the strata beyond. Accordingly, the selection of materials will ideally facilitate maximum transmission of detonation energy to the jet stream to enhance velocity and, at the same time, provide for the optimum transfer of liner material to build the longest possible jet.

At the outset it would seem that a relatively high density metal, such as tungsten, uranium, gold or lead, would be ideal to provide a dense, high velocity jet. Yet experimentation has shown that those metals used as the material for a single-layer liner have produced disappointing results. When used alone, high density metals tend to "shatter" or break up when the detonation shock wave hits the liner. Moreover, the formation of a long jet with these metals is also difficult because they possess relatively low ductility in some cases. Lead or gold, of course, are ductile.

In prior art shaped charges, copper liners have been used, because copper is relatively ductile and has a density sufficient to produce a penetrating jet at low cost. Attempts to produce bi-layer metallic liners usually employed copper as the inner layer next to the cavity and a highly vaporizable outer layer did little, if anything, to enhance the velocity and length of the jet; it simply reduced the trailing slug.

According to the present invention, the careful matching of properties for materials in bi- or multi-layered liners can markedly increase both the velocity and length of the high energy jet. While for most purposes metal and metal alloys in various physical forms will constitute the material for the layers, other materials, such as oxides and ceramics can also be employed providing they have the desirable properties.

It has been found that the considerations necessary for the production of liners in accordance with the invention include the following four major areas of concern. Good results can be achieved using just one or more of the parameters, but best results are obtained when all four considerations are used to construct the liner.

First, the amount of explosive to be used in the shaped charge must be maximized while minimizing the areal density of the liner material. For these purposes, areal density may be defined as the mass of liner material per unit area of the layer. This relationship between maximized explosive and minimized areal density may best be expressed as a ratio of energy to mass and involves the balancing of the two sides of the mass energy ratio to find the optimum for a particular combination of materials used for the liner layers. For example, if the value of the ratio is too high, i.e., too much explosive used, he liner will simply collapse without forming a jet. On the other hand, if the mass and thickness (areal density) of the layers are too great, the liner does not collapse properly either. That is to say, in attempting to maintain the same explosive charge to mass ratio, increasing the density of the liner (using gold rather than aluminum, for instance) results in an excessively thin layer which shatters.

In employing the mass/energy parameter, the important result is to maximize the explosive force passing to the inner layer of the liner and then forming the highest velocity jet possible.

The second parameter to be used in practicing the invention is that of adjusting the ductility of each layer to its optimum for the particular combination of layers and materials in those layers. The purpose of this consideration is to enhance the probability of forming a long, high density jet for greater penetration, keeping in mind that a high-penetration jet must have not only high velocity, but also greater mass to achieve the necessary momentum for deep penetration. It may be considered obvious at firt glance that a high density metal, such as tungsten, uranium, or the like in a liner, could produce a jet having high mass and great momentum. Experimentation, however, has shown that this is not always the case. Such heavy metals alone tend to form a short, heavy jet with little penetrating power, the reason being that they are not ductile enough in and of themselves to produce a long jet.

Use of this second parameter in determining the characteristics of the materials to be used in a liner results in the employment of a material having relatively greater ductility as the outside layer next to the explosive charge and a higher mass inner layer next to the cavity. Such a combination, or one in which three layers are used, results in the formation of a high density jet having a relatively long trail. The higher ductility of the outer layer has helped shape and form the long jet. In such an arrangement, for example, lower density metals, such as copper, aluminum, antimony and magnesium, or alloys of the above, are acceptable for use as outer layers for the shaped charge liner; while higher density metals, such as tungsten, uranium, tantaium, gold or lead, can be employed as inner layers. Taking into account the ductilities of materials used to form the layers and matching them to obtain the optimum for each layer provides for excellent results in achieving a high penetration jet.

There are, of course, known methods for altering ductilities of known metals, such as alloying, sintering, pressing powdered metals and use of binders for metal powders, chemical compounding, and the like, all of which are contemplated within the scope of this invention.

The third principle to be considered in selecting layer materials is that of buffering, which is the adjustment of properties of the liner materials, such as composition, thickness, ductility, acoustic impedance, areal density, etc., so as to prevent the shattering or break-up of the inner high density layer when it is struck by the shock wave of the explosive detonation. It has been determined that gold as a liner has a great tendency to simply break up upon detonation of the charge, rather than form a high velocity jet because of its weak structure. Through the principle of buffering, the outer layer next to the explosive can be chosen and adjusted as to the properties noted above to "buffer" the higher density metal inner layer, such as gold or lead, and thereby help create a very effective high density jet with a long trail capable of deep penetration.

The fourth principle to be considered in material selection is that of impedance matching. At the interface between the layers of the shaped charge liner or between the outer layer and the explosive charge, a great amount of energy from the detonation of the explosive charge can be reflected back and not traverse the interface to be used in forming the jet. Since energy travels in the form of a wave, it is desirable that as much of the energy of the wave as possible be transferred across the interface with preferably none being reflected back. In approaching this ideal, it may be desirable to employ three or more layers in a liner. If it is impossible to achieve an acceptable or optimum impedance match at the single interface between an outer and an inner layer, it usually can be attained by using three or more layers to provide two or more interfaces for closer matching.

It is well known that materials each have their own impedance, defined as the quality of the material which has an effect on the transmission, absorption and reflection of an energy wave. The matching of such impedance for the materials used in the liner provide enhanced passage of explosive energy through the liner and into the formation of the jet.

While the embodiments of the invention have been shown and described in accordance with the present invention, it is obvious that the invention is susceptible to changes and modifications known to those skilled in the art and they are included in the scope of the invention or defined in the appended claims.

We claim:

1. Method for determining liner materials to enhance the formation of high energy jets in multilayer shaped charges, comprising the steps of:

employing a high density material for an inner layer of a shaped charge said high density materials including tungston, uranium, tantalium, gold, lead and alloys thereof; and employing a lower density material for an outer layer and suitably adjusting the properties of said lower density material selected from copper, aluminum, antimony, magnesium and alloys thereof, to buffer said inner layer from shattering as a result of the detonation of a high explosive charge adjacent to said outer layer.

2. Method as set forth in claim 1, wherein more than two layers are employed, and each layer is buffered as to the adjacent layer.

3. Method as set forth in claim 1, wherein the ratio of explosive charge to liner mass ratio is adjusted.

4. Method as set forth in claim 1, wherein the ductility of the high and lower density materials is adjusted.

5. Method as set forth in claim 1, wherein the properties of thickness, and areal density of the lower density material are adjusted.

6. Method as set forth in claim 1, wherein the acoustical impedance of the high and lower density materials are adjusted to reduce energy bounce at the interface of said layers of materials.

* * * * *